US008219268B2

(12) United States Patent
Kalyanam et al.

(10) Patent No.: US 8,219,268 B2
(45) Date of Patent: Jul. 10, 2012

(54) APPARATUS AND METHOD FOR DETERMINING AVAILABLE POWER AND WEIGHT DISTRIBUTION IN A TRAIN

(75) Inventors: Krishnamoorthy Kalyanam, Bangalore (IN); Ajith Kumar, Erie, PA (US); Paul K. Houpt, Schenectady, NY (US); Manthram Sivasubramaniam, Bangalore (IN)

(73) Assignee: General Electric Company, Niskayuna, NY (US)

( * ) Notice: Subject to any disclaimer, the term of this patent is extended or adjusted under 35 U.S.C. 154(b) by 654 days.

(21) Appl. No.: 12/277,016

(22) Filed: Nov. 24, 2008

(65) Prior Publication Data

US 2010/0131128 A1 May 27, 2010

(51) Int. Cl.
*G06F 19/00* (2011.01)
*B61C 15/00* (2006.01)

(52) U.S. Cl. ..... 701/19; 246/187 C

(58) Field of Classification Search ..... 105/61, 105/73, 75, 82; 246/182 R, 182 C, 185, 186, 246/187 C; 701/1, 19, 20, 70; 180/14.1
See application file for complete search history.

(56) References Cited

U.S. PATENT DOCUMENTS

| | | | | |
|---|---|---|---|---|
| 4,042,810 | A | 8/1977 | Mosher | |
| 5,744,707 | A | 4/1998 | Kull | |
| 6,580,976 | B1 | 6/2003 | Belcea | |
| 6,691,957 | B2 * | 2/2004 | Hess et al. | 246/186 |
| 2004/0044447 | A1 * | 3/2004 | Smith | 701/19 |
| 2009/0271052 | A1 * | 10/2009 | Kumar | 701/19 |
| 2010/0131130 | A1 * | 5/2010 | Kalyanam et al. | 701/20 |
| 2010/0262321 | A1 * | 10/2010 | Daum et al. | 701/20 |

* cited by examiner

*Primary Examiner* — S. Joseph Morano
*Assistant Examiner* — Zachary Kuhfuss
(74) *Attorney, Agent, or Firm* — Richard A. DeCristofaro

(57) ABSTRACT

A navigation system includes a computer readable storage medium having a sequence of instructions stored thereon, which, when executed by a processor, causes the processor to acquire a plurality of parameters of a train comprising parameters measured after the train has begun a journey. The train includes a plurality of vehicles providing tractive effort and a consist coupled to the plurality of vehicles. The sequence of instructions also causes the processor to calculate the tractive effort of less than all of the plurality of vehicles based on the acquired plurality of parameters.

15 Claims, 2 Drawing Sheets

APPARATUS AND METHOD FOR DETERMINING AVAILABLE POWER AND WEIGHT DISTRIBUTION IN A TRAIN

BACKGROUND

1. Technical Field

The invention includes embodiments that relate to determination of available power and weight distribution in a train.

2. Discussion of Art

In operating a train having, for example, a plurality of vehicles providing power to move the train and another plurality of vehicles to be pulled or pushed by the power vehicles, some of the factors that an operator or driving system may take into account include environmental conditions, grade or slope, track or path curvature, speed limits, vehicle size, an amount of supply power, both motoring and braking, available from the power vehicles, weight of the cargo, and the distribution of that weight along the train.

A navigation system capable of operating the train or assisting the vehicle operator may benefit from a determination of available power and weight distribution in a train, which may not be available or known prior to beginning a journey or trip along a train route. Operating a train when one or more parameters are unknown may lead to excess fuel consumption and inaccurate train stopping distances under, for example, different grade conditions.

It may be desirable to have a system that has aspects and features that differ from those systems that are currently available. It may be desirable to have a method that differs from those methods that are currently available.

BRIEF DESCRIPTION

Embodiments of the invention also provide a navigation system includes a computer readable storage medium having a sequence of instructions stored thereon, which, when executed by a processor, causes the processor to acquire a plurality of parameters of a train comprising parameters measured after the train has begun a journey. The train includes a plurality of vehicles providing tractive effort and a consist coupled to the plurality of vehicles. The sequence of instructions also causes the processor to calculate the tractive effort of less than all of the plurality of vehicles based on the acquired plurality of parameters.

Embodiments of the invention also provide a system includes a first plurality of vehicles coupled together and a second plurality of vehicles coupled together and coupled to the first plurality of vehicles. The second plurality of vehicles is configured to provide tractive effort to move the first plurality of vehicles and includes a primary vehicle and at least one secondary vehicle. The system further includes a computer having one or more processors programmed to measure a plurality of parameters of the primary vehicle while the second plurality of vehicles is providing tractive effort and calculate the tractive effort of the at least one secondary vehicle based on the measured plurality of parameters of the primary vehicle.

Embodiments of the invention also provide a method includes measuring a plurality of tractive effort values of a lead locomotive of a train moving along a route and measuring a plurality of speed values of the train moving along the route. The method also includes estimating the tractive effort of one or more trail locomotives of the train based on the measured plurality of tractive effort values and the measured plurality of speed values.

Various other features will be apparent from the following detailed description and the drawings.

BRIEF DESCRIPTION OF THE DRAWINGS

The drawings illustrate embodiments contemplated for carrying out the invention. For ease of illustration, a train powered by locomotives has been identified, but other vehicles and train types are included except were language or context indicates otherwise.

DETAILED DESCRIPTION

The invention includes embodiments that relate to navigation systems. The invention also includes embodiments that relate to estimation of train parameters. The invention includes embodiments that relate to methods for estimating of train parameters.

According to one embodiment of the invention, a navigation system includes a computer readable storage medium having a sequence of instructions stored thereon, which, when executed by a processor, causes the processor to acquire a plurality of parameters of a train comprising parameters measured after the train has begun a journey. The train includes a plurality of vehicles providing tractive effort and a consist coupled to the plurality of vehicles. The sequence of instructions also causes the processor to calculate the tractive effort of less than all of the plurality of vehicles based on the acquired plurality of parameters.

According to one embodiment of the invention, a system includes a first plurality of vehicles coupled together and a second plurality of vehicles coupled together and coupled to the first plurality of vehicles. The second plurality of vehicles is configured to provide tractive effort to move the first plurality of vehicles and includes a primary vehicle and at least one secondary vehicle. The system further includes a computer having one or more processors programmed to measure a plurality of parameters of the primary vehicle while the second plurality of vehicles is providing tractive effort and calculate the tractive effort of the at least one secondary vehicle based on the measured plurality of parameters of the primary vehicle.

According to one embodiment of the invention, a method includes measuring a plurality of tractive effort values of a lead locomotive of a train moving along a route and measuring a plurality of speed values of the train moving along the route. The method also includes estimating the tractive effort of one or more trail locomotives of the train based on the measured plurality of tractive effort values and the measured plurality of speed values.

Figure 1:
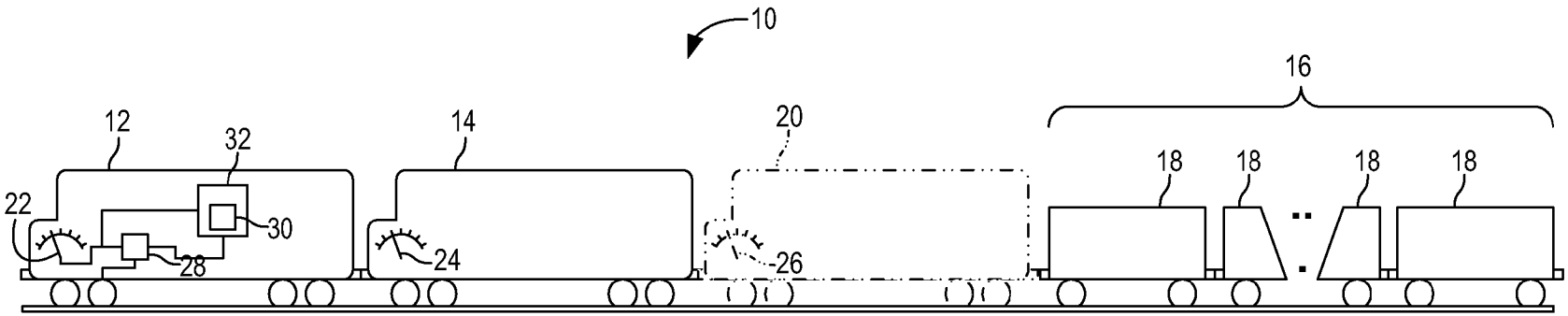
FIG. 1 is an illustration showing a train with a navigation system according to an embodiment of the invention.

FIG. 1 shows train with a navigation system according to an embodiment of the invention. A train 10 includes a plurality of tractive effort vehicles 12, 14 that provide tractive effort or power to push or pull or slow a consist 16. Tractive effort vehicles 12, 14 provide motoring tractive effort and braking tractive effort including dynamic braking and air braking. In an embodiment of the invention, vehicles 12, 14 are railroad locomotives; however, other vehicles and train types are contemplated. The number of locomotives 12, 14 in train 10 may vary depending on, for example, the number of cars or vehicles 18 in consist 16 and the load they are carrying. As shown, train 10 includes two locomotives 12, 14. However, as shown in phantom, additional locomotives 20 may be included. Cars 18 may be any of a number of different types of cars for carrying freight or passengers.

In one embodiment, one of the locomotives, for example, locomotive 12, is a master or command vehicle, and the remaining locomotives, for example, locomotive 14 and locomotives 20 if included, are slave or trail vehicles. In this manner, an operator or engineer or vehicle navigation system may control the set of locomotives 12-14, 20 by controlling the command vehicle. For example, the operator or vehicle navigation system may set a throttle 22 of locomotive 12 to a first notch position, and the throttles 24, 26 of the trail vehicles 14, 20 move to the first notch position accordingly. As shown, locomotive 12 is the lead locomotive and may be the command vehicle. However, it is contemplated that any of the plurality of tractive effort vehicles 12-14, 20 may be the command vehicle from which the remaining trail locomotives receive commands. The locomotives may be positioned anywhere in the train such as at the front of the consist 16, between groups of cars 18 of the consist 16, or at an back of consist 16.

According to an embodiment of the invention, lead locomotive 12 includes a sensor system 28 configured to measure a speed of train 10 and the tractive effort or horsepower of lead locomotive 12. Values or parameters measured via a sensor system 28 are input and read by a computer 30 for determination of available power and weight distribution of train 10 as discussed in greater detail below. In an embodiment, computer 30 is part of a navigation system 32 configured to operate train 10 according to a plan determined in part by the determined available power and weight distribution of train 10.

Motion for the train, assuming it is a point mass, may be approximated using a point mass model of the form:

$$\dot{v} = \frac{P}{v}\alpha - (a + bv + cv^2) - g, \qquad \text{(Eqn. 1)}$$

where $\alpha$ represents the inverse of the weight M of the train. The engine power P and the train speed v represent the input and output of the system, respectively. Davis model parameters a, b, and c represent train resistance, and g represents contributions due to grade or gradient.

According to an embodiment of the invention, horsepower for the trail vehicles or locomotives is to be estimated at different throttle notch settings after the train has begun a journey or trip along a route. Estimation of the trail horsepower is performed when the trail horsepower is not known or has not been identified before the trip. At each time instant, k, the horsepower of the lead locomotive, $P_k^l$, and the train speed, $v_k$, are available through measurements taken during the trip. Terrain information is also captured and represented by the gradient variable, $g_k$. Using this information, horsepower of the trail locomotives may be estimated.

To simplify estimation of the trail locomotive horsepower, the trail locomotives are held at a particular notch setting. This helps to ensure that the horsepower generated by the trail locomotives will be a constant and, therefore, easier to estimate. The lead locomotive need not necessarily be held at a constant notch or at the same notch position as the trail locomotives. Once an estimation of the trail horsepower for a particular notch has been completed, the notch of the trail locomotives may be moved to a different position, and estimation of the trail horsepower for the new notch position may be completed. In this manner, the trail horsepower for all notch settings may be determined according to embodiments of the invention.

The continuous time train model of Eqn. 1 having power P split into two parts results in the equation:

$$\dot{v} = \frac{P^l + P^t}{v}\alpha - (a + bv + cv^2) - g \qquad \text{(Eqn. 2)}$$
$$\Rightarrow v\dot{v} = P^l\alpha + P^t\alpha - (av + bv^2 + cv^3) - gv,$$

where the superscripts l and t represent the horsepower of the command or lead locomotive and of the remaining or trail locomotives, respectively. The train mass and the Davis coefficients are acquired from known values.

The continuous time train model of Eqn. 2 is converted to a discrete time equivalent model because data is available at discrete time instants. For this conversion, a trapezoidal discretization method is used that results in the discrete time model:

$$\left(\frac{v_{k+1} + v_k}{2}\right)\left(\frac{v_{k+1} - v_k}{\delta t}\right) = \frac{P^t\alpha + P_{k+1}^l\alpha - av_{k+1} - bv_{k+1}^2 - cv_{k+1}^3 - g_{k+1}v_{k+1}}{2} + \frac{P^t\alpha + P_k^l\alpha - av_k - bv_k^2 - cv_k^3 - g_k v_k}{2}. \qquad \text{(Eqn. 3)}$$

Collecting terms with $P^t$ results in the data model:

$$2P^t\alpha = \frac{v_{k+1}^2 - v_k^2}{\delta t} + g_{k+1}v_{k+1} + g_k v_k - (P_{k+1}^l + P_k^l)\alpha + (v_{k+1} + v_k)a + (v_{k+1}^2 + v_k^2)b + (v_{k+1}^3 + v_k^3)c. \qquad \text{(Eqn. 4)}$$

All of the known values on the right-hand side of Eqn. 4 are denoted by the variable $y_k$. That is, $\alpha$ represents the inverse of the weight of the train; k represents a time point; $P_k^l$ represents a measured tractive effort parameter of the command vehicle; v represents a measured speed of the train; $\delta t$ represents a time difference between k and k+1; a, b, and c represent train resistance parameters; and g represents a grade parameter. A perfect knowledge of model parameters of Eqn. 4 results in the equation:

$$2P^t\alpha = y_k \forall k \qquad \text{(Eqn. 5).}$$

However, because of modeling or observation errors, a best estimate of trail horsepower $\hat{P}_t$ is calculated that will minimize the sum of squared errors $$\sum_1^n \eta_k^2$$

where $\eta_k = 2\hat{P}^t\alpha - y_k$. The best estimate has the simple average given by:

$$\hat{P}^t = \frac{1}{2\alpha n}\sum_1^n y_k. \qquad \text{(Eqn 6)}$$

A running equation may be used instead of Eqn. 6. The running equation may be used where storing data in computer memory of $y_k$ for all k is not desired. The running average formulation may be defined as:

$$\hat{P}^t_{k+1} = \frac{1}{k+1}\left(\hat{P}^t_k k + \frac{y_{k+1}}{2\alpha}\right). \quad \text{(Eqn. 7)}$$

Hence, the previous best estimate $\hat{P}_k{}^t$ and the current data $y_{k+1}$ may be used to determine the new estimate $\hat{P}_{k+1}{}^t$.

Different cars in the train might be loaded or empty. Accordingly, the weight distribution of the train may not be uniform throughout. The non-uniform weight distribution has implications in terms of train handling and braking. Therefore, estimation of the weight distribution along the length of the train is desired. For this, it is assumed that the total horsepower generated by all of the locomotives $P_k$ is available at any time instant.

The lumped train model found in Eqn. 1 is an approximation of the true train. This model is expanded to account for the resistance seen by each car and locomotive such that the dependence on the weight of each of these units is brought out.

The Davis parameters for a given unit, such as a car or locomotive of the train, may be defined as:

$$A = d_a + d_b\frac{n}{\omega} \quad \text{(Eqn. 8)}$$
$$B = d_c$$
$$C = d_d\frac{a}{\omega},$$

where n is the number of axles in the unit; a is a cross-sectional area of the unit; $d_a$, $d_b$, $d_c$, and $d_d$ are constants that depend on the unit; and w is the weight of the unit. Recalling Eqn. 1, the lumped train model is:

$$\dot{\upsilon} = \frac{P}{\upsilon}\alpha - (a + b\upsilon + c\upsilon^2) - g, \quad \text{(Eq. 9)}$$

where the lumped Davis parameters are weighted averages of the individual unit or car/locomotive parameters.

Accordingly, the Davis parameters may be written as:

$$a = \left(d^l_a + d^l_b\frac{n^l}{w^l}\right)(m+1)w^l\alpha + \sum_{i=1}^{N}\left(d^c_a + d^c_b\frac{n^c}{w^c_i}\right)w^c_i\alpha \quad \text{(Eq. 10)}$$
$$b = d^l_c(m+1)w^l\alpha + \sum_{i=1}^{N} d^c_c w^c_i\alpha$$
$$c = \left(d^l_d a^l + m d^t_d a^t + \sum_{i=1}^{N} d^c_d a^c_i\right)\alpha,$$

where $w^l$ denotes the weight of a vehicle or locomotive and $w_i{}^c$ denotes the weight of the $i^{th}$ car of the consist. The effective grade g may be written as a weighted average of the individual grade seen by each unit:

$$g = \left(\sum_{j=1}^{m+1} g^l_j w^l + \sum_{i=1}^{N} g^c_i w^c_i\right)\alpha, \quad \text{(Eqn. 11)}$$

where the superscripts l, t, and c denote lead locomotive, trail locomotive, and car, respectively.

Referring to Eqn. 10, it is noted that c is independent of the unit weights. Collecting the terms in a and c that are independent of weights, w, results in:

$$\bar{a} = d^l_b n^l(m+1) + d^c_b n^c N \quad \text{(Eqn. 12)}$$
$$\bar{c} = d^l_d a^l + m d^t_d a^t + \sum_{i=1}^{N} d^c_d a^c_i,$$

where m and N are the number of trail locomotives and cars, respectively. Substituting for a, b, and c from Eqn. 10 into Eqn. 9 and multiplying both sides by v, results in the distributed train model:

$$\upsilon\dot{\upsilon} = (P - \bar{a}\upsilon - \bar{c}\upsilon^3)\alpha - (d^l_a\upsilon + d^l_c\upsilon^2)(m+1)\omega^l\alpha - \sum_{j=1}^{m+1} g^l_j\upsilon w^l\alpha - \sum_{i=1}^{N}(d^c_a\upsilon + d^c_c\upsilon^2 + g^c_i\upsilon)w^c_i\alpha. \quad \text{(Eqn. 13)}$$

Using trapezoidal discretization with sampling time δt, Eqn. 13 can be converted into the discrete time model:

$$\begin{aligned}(\upsilon_{k+1} + \upsilon_k)\left(\frac{\upsilon_{k+1} - \upsilon_k}{\delta t}\right) = {} & (P_{k+1} - \bar{a}\upsilon_{k+1} - \bar{c}\upsilon^3_{k+1})\alpha - (d^l_a\upsilon_{k+1} + d^l_c\upsilon^2_{k+1})(m+1)w^l\alpha - \\ & \sum g^l_{j,k+1}\upsilon_{k+1}\omega^l\alpha - \sum(d^c_a\upsilon_{k+1} + d^c_c\upsilon^2_{k+1} + g^c_{i,k+1}\upsilon_{k+1})w^c_i\alpha + \\ & (P_k - \bar{a}\upsilon_k - \bar{c}\upsilon^3_k)\alpha - (d^l_a\upsilon_k + d^l_c\upsilon^2_k)(m+1)w^l\alpha - \\ & \sum g^l_{j,k}\upsilon_k w^l\alpha - \sum(d^c_a\upsilon_k + d^c_c\upsilon^2_k + g^c_{i,k}\upsilon_k)w^c_i\alpha,\end{aligned} \quad \text{(Eqn. 14)}$$

where k denotes the time index. Assuming that the mass of a locomotive $w^l$ is known and having the constraint that the consist and the load mass have to add up to the train mass, i.e., $$(m+1)\omega^l + \sum\omega^c_i \quad \text{(Eqn. 15)}$$
$$\Rightarrow (m+1)\omega^l\alpha + \sum\omega^c_i\alpha = 1,$$

A substitution for $w^l\alpha$ in Eqn. 14 results in the data model:

$$\begin{aligned}\frac{\upsilon^2_{k+1} - \upsilon^2_k}{\delta t} + d^l_a\upsilon_{k+1} + d^l_c\upsilon^2_{k+1} + \bar{g}^l_{k+1}\upsilon_{k+1} + \bar{g}^l_k\upsilon_k = {} & (P_{k+1} - \bar{a}\upsilon_{k+1} - \bar{c}\upsilon^3_{k+1})\alpha + (d^l_a\upsilon_{k+1} + d^l_c\upsilon^2_{k+1})\sum w^c_i\alpha - \\ & \sum(d^c_a\upsilon_{k+1} + d^c_c\upsilon^2_{k+1} + g^c_{i,k+1}\upsilon_{k+1})w^c_i\alpha + \\ & (P_k - \bar{a}\upsilon_k - \bar{c}\upsilon^3_k)\alpha + (d^l_a\upsilon_k + d^l_c\upsilon^2_k)\sum w^c_i\alpha - \\ & \sum(d^c_a\upsilon_k + d^c_c\upsilon^2_k + g^c_{i,k}\upsilon_k)w^c_i\alpha(\bar{g}^l_{k+1}\upsilon_{k+1} + \bar{g}^l_k\upsilon_k)\sum w^c_i\alpha,\end{aligned} \quad \text{(Eqn. 16)}$$

where $$\bar{g}_k^l = \frac{1}{m+1}\sum_{j=1}^{m+1} g_{j,k}^l$$

denotes the grade averaged over the locomotives.

The data model of Eqn. 16 can be used to define the fit error:

$$\eta_k = \hat{\theta}\phi_k - y_k,$$

where the unknown vector $\theta=[\alpha\ w_1^c\alpha\ \ldots\ w_Q^c\alpha]$ and $\hat{\theta}$ denotes its best estimate, where Q denotes the number of subdivisions of the train for estimating the weight distribution, where $$y_k = \frac{v_{k+1}^2 - v_k^2}{\delta t} + d_a^l v_{k+1} + d_c^l v_{k+1}^2 + \bar{g}_{k+1}^l v_{k+1} + \bar{g}_k^l v_k,$$

and where $$\phi_k = \begin{bmatrix} P_k + P_{k+1} - \bar{a}(v_k + v_{k+1}) - \bar{c}(v_k^3 + v_{k+1}^3) \\ (d_a^l - d_a^c)(v_k + v_{k+1}) + (d_c^l - d_c^c)(v_k^2 + v_{k+1}^2) + \\ (\bar{g}_k^l - g_{1,k}^c)v_k + (\bar{g}_{k+1}^l - g_{1,k+1}^c)v_{k+1} \\ \vdots \end{bmatrix}.$$

Supposing that there are r such data points, then the data points can be stacked to get the regressor vector $\Phi=[\phi_1 \ldots \phi_r]$ and the output vector $Y=[y_1 \ldots y_r]$. $\eta$ represents an error vector $[\eta_1 \ldots \eta_r]$. This results in the matrix relation:

$$\theta\Phi = Y + \eta \qquad \text{(Eqn. 17).}$$

Again, the estimation problem can be posed as the quadratic programming problem:

$$\begin{aligned} &\min_\theta (Y - \theta\Phi)(Y - \theta\Phi)' \qquad \text{(Eqn. 18)} \\ &\Rightarrow \min_\theta \theta\Phi\Phi'\theta' - 2Y\Phi'\theta' \\ &\Rightarrow \min_\theta \frac{1}{2}\theta H\theta' + f\theta', \end{aligned}$$

where $H=2\Phi\Phi'$ and $f=-2Y\Phi'$, subject to the linear constraints that the sum of weights of all units should equal the total train weight, $$[(m+1)w^l 1 \ldots 1]\theta' = 1 \qquad \text{(Eqn. 19),}$$

and that the individual car weights should be greater than the weight of an empty car, $$\begin{aligned} &w_i^c \geq w_e \qquad \text{(Eqn. 20)} \\ &\Rightarrow w_e\alpha - w_i^c\alpha \leq 0,\ i = 1 \ldots N, \end{aligned}$$

where $w_e$ is the weight of an empty car.

Figure 2:
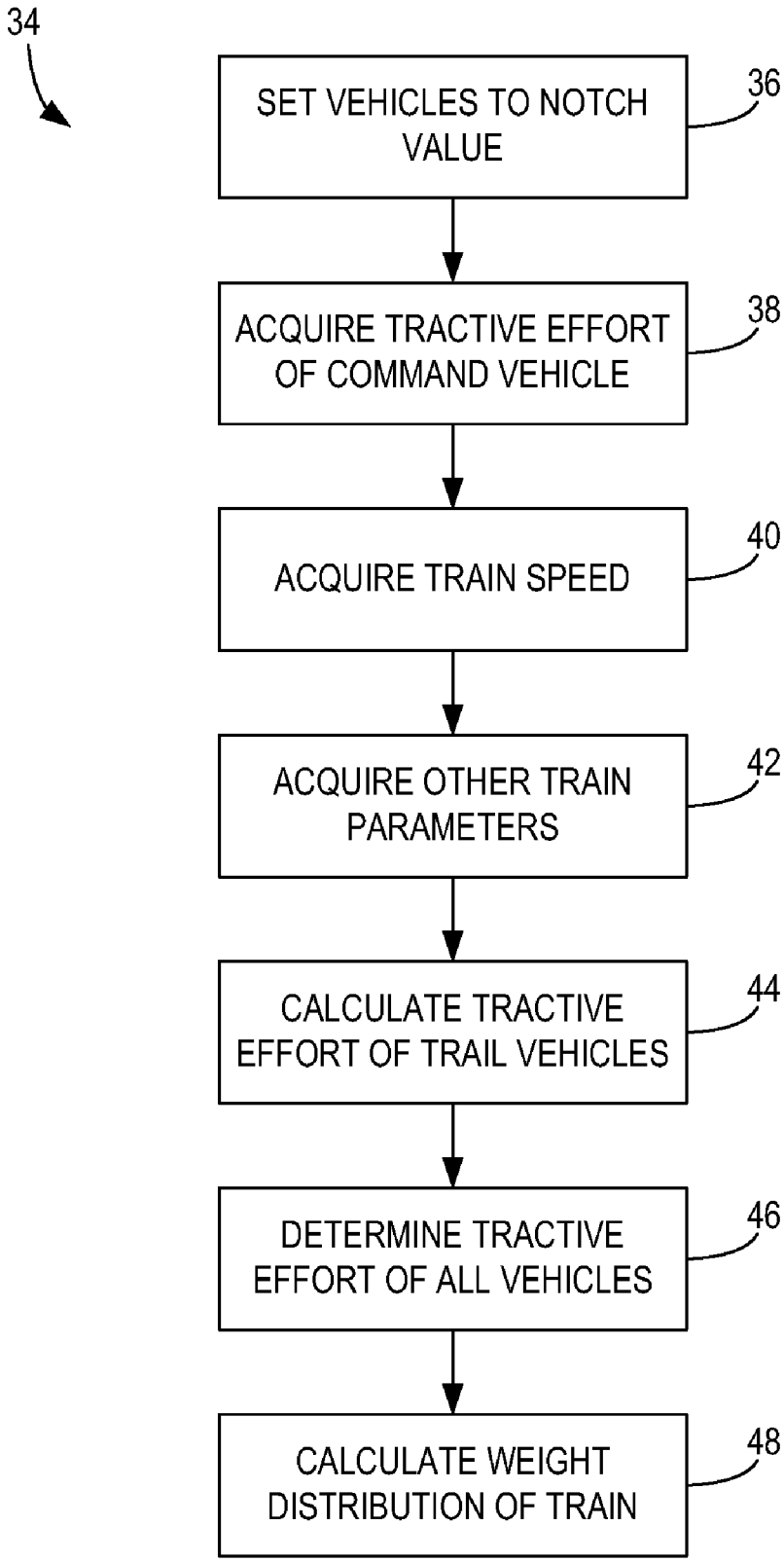
FIG. 2 is a flowchart illustrating a technique for determining available power and weight distribution in a train according to an embodiment of the invention.

FIG. 2 shows a technique 34 for determining available power and weight distribution in a train according to an embodiment of the invention. In an embodiment, technique 34 may be programmed into computer 30 of train 10 shown in of FIG. 1 or may be stored on a computer readable storage medium readable via computer 30 such that a processor (not shown) of computer 30 may be caused to perform technique 34. In an embodiment of the invention, the computer readable storage medium may be, for example, floppy disk drives, tape drives, CD-ROM drives, DVD-RW drives, external and internal hard drives, flash drives, and the like.

Once a train, such as train 10 of FIG. 1, has begun a journey along a route, technique 34 may be performed to estimate the tractive effort or horsepower of trail vehicles are locomotives and to estimate a weight distribution along the train such that a route plan may be calculated to optimize fuel efficiency used by the train during the journey. Accordingly, a navigation system may use the route plan to automatically operate the train through to a destination of the train. Alternatively, the route plan may be used to assist an engineer operating the train to increase or maximize fuel efficiency of the train's operation.

According to an embodiment of the invention, technique 34 includes setting the trail vehicles to a notch value at step 36. Setting the trail vehicles to the same notch value allows calculation of their tractive effort at that notch value. It is contemplated that technique 34 may be performed for each notch value for which it is desirable to calculate the tractive effort of the trail vehicles. Technique 34 includes acquiring the tractive effort of the command or lead vehicle at step 38 and acquiring a speed of the train at step 40. The lead vehicle tractive effort and the train speed are accordingly acquired after the train has begun the journey. Technique 34 also includes acquiring other train parameters at step 42. The other parameters include parameters such as the Davis parameters, grade or gradient parameters, and a mass of the train. These other train parameters may be acquired from stored values determined or calculated before or after the train has begun the journey. Acquiring other train parameters 34 also includes acquiring a previously-calculated tractive effort estimation of the trail vehicles if available.

Once the lead vehicle tractive effort, train speed, and other parameters are acquired, technique 34 calculates the tractive effort or horsepower of the trail vehicles at step 44. Calculation of the trail vehicle tractive effort includes calculating or estimating the tractive effort according to the equations described above. That is, the trail vehicle tractive effort may be estimated via Eqns. 6 or 7, for example. After the tractive effort of the trail vehicles has been calculated, the tractive effort of all the vehicles may be determined at step 46. The tractive effort of all the vehicles may be used in combination with the equations described above to calculate a weight distribution of the train at step 48. The weight distribution may be calculated, for example, via Eqn. 18 subject to the constraints identified in Eqn. 19.

A technical contribution for the disclosed method and apparatus is that it provides for a computer-implemented determination of available power and weight distribution in a train.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not limited by the foregoing description, but is only limited by the scope of the appended claims.

What is claimed is:

1. A navigation system comprising:

a computer readable storage medium having a sequence of instructions stored thereon, which, when executed by a processor, causes the processor to:

acquire a plurality of parameters of a train comprising parameters measured after the train has begun a journey, wherein the train comprises:

a plurality of vehicles providing tractive effort; and a consist coupled to the plurality of vehicles;

and wherein acquiring a plurality of parameters comprises:

acquiring a plurality of tractive effort parameters of a command vehicle of the plurality of vehicles, each tractive effort parameter measured at a distinct time after the train has begun the journey; and acquiring a plurality of speed parameters of the train, each speed parameter measured at a distinct time after the train has begun the journey;

calculate the tractive effort of less than all of the plurality of vehicles based on the acquired plurality of parameters;

determine a plurality of combined tractive effort parameters of all of the plurality of vehicles based on a plurality of the acquired tractive effort parameters of the command vehicle and based on a plurality of calculated tractive effort parameters of the less than all of the plurality of vehicles; and calculate a distribution of a weight of the train based on the determined plurality of combined tractive effort parameters and based on a plurality of the acquired speed parameters of the train.

2. The navigation system of claim 1 wherein the instructions that cause the processor to acquire the plurality of tractive effort parameters of the command vehicle cause the processor to acquire the plurality of tractive effort parameters of the lead vehicle.

3. The navigation system of claim 1 wherein the instructions that cause the processor to calculate the tractive effort cause the processor to:

calculate the tractive effort of the plurality of vehicles less the command vehicle.

4. The navigation system of claim 3 wherein the instructions that cause the processor to acquire the plurality of parameters of the train cause the processor to:

acquire a mass of the train;

acquire a plurality of train resistance parameters; and acquire a plurality of grade parameters.

5. The navigation system of claim 4 wherein the instructions that cause the processor to calculate the tractive effort of the plurality of vehicles less the lead vehicle cause the processor to calculate the tractive effort in accordance with:

$$\hat{P}_{k+1}^{t} = \frac{1}{k+1}\left(\hat{P}_k^t k + \frac{y_{k+1}}{2\alpha}\right),$$

where:

$\hat{P}_{k+1}^{t}$ represents a current estimate of horsepower of the plurality of vehicles less the command vehicle; $\hat{P}_k^t$ represents a previous best estimate of the horsepower; $\alpha$ represents the inverse of the weight of the train; k represents a time point;

$y_k$ represents $$\frac{v_{k+1}^2 - v_k^2}{\delta t} + g_{k+1}v_{k+1} + g_k v_k - (P_{k+1}^l + P_k^l)\alpha + (v_{k+1} + v_k)a + (v_{k+1}^2 + v_k^2)b + (v_{k+1}^3 + v_k^3)c;$$

$P_k^l$ represents a measured tractive effort parameter of the command vehicle; v represents a measured speed of the train; $\delta t$ represents a time difference between k and k+1; a, b, and c represent train resistance parameters; and g represents a grade parameter.

6. The navigation system of claim 1 wherein the instructions that cause the processor to acquire the plurality of tractive effort parameters of the command vehicle cause the processor to acquire the plurality of tractive effort parameters of a locomotive.

7. The navigation system of claim 1 wherein the instructions that cause the processor to calculate the distribution of a weight of the train cause the processor to calculate the distribution in accordance with:

$$\min_\theta (Y-\theta\Phi)(Y-\theta\Phi)',$$

where:

$\theta\Phi = Y+\eta$; y represents an output vector $[y_1 \ldots y_r]$; $\Phi$ represents a regressor vector $[\phi_1 \ldots \phi_r]$; $\eta$ represents an error vector $[\eta_1 \ldots \eta_r]$;

$$\eta_k = \hat{\theta}\phi_k - y_k;$$

$$\theta = [\alpha\, w_1^c\, \alpha \ldots w_Q^c \alpha];$$

$$y_k = \frac{v_{k+1}^2 - v_k^2}{\delta t} + d_a^l v_{k+1} + d_c^l v_{k+1}^2 + \bar{g}_{k+1}^l v_{k+1} + \bar{g}_k^l v_k;$$

$$\phi_k = \begin{bmatrix} P_k + P_{k+1} - \bar{a}(v_k + v_{k+1}) - \bar{c}(v_k^3 + v_{k+1}^3) \\ (d_a^l - d_a^c)(v_k + v_{k+1}) + (d_c^l - d_c^c)(v_k^2 + v_{k+1}^2) + \\ (\bar{g}_k^l - g_{1,k}^c)v_k + (\bar{g}_{k+1}^l - g_{1,k+1}^c)v_{k+1} \\ \vdots \end{bmatrix};$$

$$\bar{a} = d_b^l n^l (m+1) + d_b^c n^c N$$

$$\bar{c} = d_d^l a^l + m d_d^t a^t + \sum_{i=1}^{N} d_d^c a_i^c;$$

where k and r represent a number of data points; P represents a combined tractive effort parameter; v represents a measured speed of the train; n represents a number of axles in a unit; a is a cross-sectional area of a unit; $d_a$, $d_b$, $d_c$, and $d_d$ are constants that depend on the unit; the superscripts l, t, and c represent the command vehicle, the vehicles other than the command vehicle, and a car of the consist, respectively; $w^l$ and $w_i^c$ denote the weight of a vehicle and the $i^{th}$ car of the consist, respectively; m represents the number of vehicles less than command vehicle; N represents the number of cars of the consist; g represents a grade parameter; and where $$\bar{g}_k^l = \frac{1}{m+1}\sum_{j=1}^{m+1} g_{j,k}^l$$

denotes the grade averaged over the plurality of vehicles.

8. The navigation system of claim 7 wherein the instructions that cause the processor to calculate the distribution of a weight of the train further cause the processor to calculate the distribution in accordance with the constraints:

$$[\,(m+1)\omega^t \quad 1 \ldots 1\,]\theta' = 1, \text{ and}$$

$$\omega_i^c \geq \omega_e$$

$$\Rightarrow \omega_e\alpha - \omega_i^c\alpha \leq 0,\ i = 1 \ldots N,$$

where $w_e$ represents the weight of an empty car of the consist.

9. The navigation system of claim 1 wherein the instructions further cause the processor to control the plurality of vehicles via a first common power control value; and wherein the instructions that cause the processor to calculate the tractive effort cause the processor to calculate the tractive effort of less than all of the plurality of vehicles controlled via the first common power control value.

10. The navigation system of claim 9 wherein the instructions further cause the processor to control the plurality of vehicles via a second common power control value, the second common power control value different than the first common power control value; and wherein the instructions that cause the processor to calculate the tractive effort cause the processor to calculate the tractive effort of less than all of the plurality of vehicles controlled via the second common power control value.

11. A system comprising:

a first plurality of vehicles coupled together;

a second plurality of vehicles coupled together and coupled to the first plurality of vehicles, the second plurality of vehicles configured to provide tractive effort to move the first plurality of vehicles and comprising:

a primary vehicle; and at least one secondary vehicle; and a computer having one or more processors programmed to:

measure a plurality of parameters of the primary vehicle while the second plurality of vehicles is providing tractive effort, comprising:

measuring a tractive effort of the primary vehicle; and measuring a speed of the first and second plurality of vehicles;

acquire a mass of the first and second plurality of vehicles;

acquire a plurality of resistance parameters of the first and second plurality of vehicles;

acquire a plurality of grade parameters of the first and second plurality of vehicles; and calculate the tractive effort of the at least one secondary vehicle based on the measured plurality of parameters of the primary vehicle, and wherein the one or more processors, in being programmed to calculate the tractive effort of the at least one secondary vehicle, are programmed to calculate the tractive effort in accordance with:

$$\hat{P}_{k+1}^t = \frac{1}{k+1}\left(\hat{P}_k^t k + \frac{y_{k+1}}{2\alpha}\right),$$

where:

$\hat{P}_{k+1}^t$ represents a current estimate of horsepower of the plurality of vehicles less the command vehicle; $\hat{P}_k^t$ represents a previous best estimate of the horsepower; $\alpha$ represents the inverse of the weight of the train; k represents a time point;

$y_k$ represents $$\frac{v_{k+1}^2 - v_k^2}{\delta t} + g_{k+1}v_{k+1} + g_k v_k - (P_{k+1}^t + P_k^t)\alpha + (v_{k+1} + v_k)a + (v_{k+1}^2 + v_k^2)b + (v_{k+1}^3 + v_k^3)c;$$

$P_k$ represents a measured tractive effort parameter of the command vehicle; v represents a measured speed of the train; $\delta t$ represents a time difference between k and k+1; a, b, and c represent train resistance parameters; and g represents a grade parameter.

12. The system of claim 11 wherein the tractive effort of the at least one secondary vehicle is a parameter that is unknown to the one or more processors prior to the calculation thereof.

13. The system of claim 11 wherein the one or more processors are further programmed to:

determine a tractive effort of the primary and at least one secondary vehicles based on a measured tractive effort of the primary vehicle and based on a calculated tractive effort of the at least one secondary vehicle; and calculate a distribution of a weight of the first and second plurality of vehicles based on the determined tractive effort and based on a measured speed of the first and second plurality of vehicles.

14. A method comprising:

measuring a plurality of tractive effort values of a lead locomotive of a train moving along a route;

measuring a plurality of speed values of the train moving along the route;

estimating the tractive effort of one or more trail locomotives of the train based on the measured plurality of tractive effort values and the measured plurality of speed values, the estimating comprising estimating the tractive effort in accordance with:

$$\hat{P}_{k+1}^t = \frac{1}{k+1}\left(\hat{P}_k^t k + \frac{y_{k+1}}{2\alpha}\right),$$

where:

$\hat{P}_{k+1}^t$ represents a current estimate of horsepower of the plurality of vehicles less the command vehicle; $\hat{P}_k^t$ represents a previous best estimate of the horsepower; $\alpha$ represents the inverse of the weight of the train; k represents a time point;

$y_k$ represents $$\frac{v_{k+1}^2 - v_k^2}{\delta t} + g_{k+1}v_{k+1} + g_k v_k - (P_{k+1}^t + P_k^t)\alpha + (v_{k+1} + v_k)a + (v_{k+1}^2 + v_k^2)b + (v_{k+1}^3 + v_k^3)c;$$

$P_k$ represents a measured tractive effort parameter of the command vehicle; v represents a measured speed of the train; $\delta t$ represents a time difference between k and k+1; a, b, and c represent train resistance parameters; and g represents a grade parameter.

15. The method of claim 14 estimating the tractive effort comprises estimating the tractive effort for each throttle setting of the one or more trail locomotives.

* * * * *